US005299685A

United States Patent [19]

Chin

[11] Patent Number: 5,299,685

[45] Date of Patent: Apr. 5, 1994

[54] TENSION AND FREELY ADJUSTABLE PROTECTIVE CASE FOR REMOTE CONTROL UNIT

[76] Inventor: C. H. Chin, 3rd Fl., No. 38, Jin-Nan St., Taichung City, Taiwan

[21] Appl. No.: 59,304

[22] Filed: May 11, 1993

[51] Int. Cl.[5] ..... B65D 85/38

[52] U.S. Cl. ..... 206/320; 206/586

[58] Field of Search ..... 206/320, 586

[56] References Cited

U.S. PATENT DOCUMENTS

| | | | |
|---|---|---|---|
| 4,739,897 | 4/1988 | Butler | 206/320 X |
| 4,762,227 | 8/1988 | Patterson | 206/320 X |
| 4,824,059 | 4/1989 | Butler | 206/320 X |
| 4,925,149 | 5/1990 | Di Francesca et al. | 206/320 |
| 5,092,459 | 3/1992 | Uljanic et al. | 206/320 |
| 5,195,634 | 3/1993 | Zaug | 206/320 |

*Primary Examiner*—William I. Price

*Attorney, Agent, or Firm*—Harrison & Egbert

[57] ABSTRACT

This invention is a tension and freely adjustable protective case for remote control units of electric or electronic products. It's a set of stretchable and contractable protective case that can be extended or reduced in height, width and length to cover the case of any remote control unit, regardless of its sizes and brands, so that the remote control unit would not be damaged by accidental collision (such as the drop to the floor) which may lead to abnormal operation due to mul-functioning of its internal circuitry.

15 Claims, 4 Drawing Sheets

TENSION AND FREELY ADJUSTABLE PROTECTIVE CASE FOR REMOTE CONTROL UNIT

TECHNICAL FIELD

The present invention relates to devices for providing protective coverings to remote control units.

BACKGROUND OF THE INVENTION

In this scientific and technological society exploded with information, almost every one faces the choice of achieving his or her goal by fastest and most effective means. Let us take electric or electronic products as an example. These products are improved generation by generation, mainly to provide simpler, easier and more complete operation modes for users. As a result, remote control units of various shapes and functions for electric or electronic products are developed one by one. To coordinate with the current trend of designing light, thin and small items, the controlling consoles of many new electric or electronic products are housed in external remote control units.

As remote control units are mostly compact and light, they are easily damaged by a careless drop to the floor. As a damaged remote control unit may affect the functions of the eletric or electronic product under its control, it is obvious that remote control unit requires a protective device to avoid damage against accidental collision or shock, and to maintain its normal function.

PRIOR ART OF THE INVENTION

FIG. 1 is an example of the protective device available on the market now for remote control units. This device is formed by four rubber cases (2) that cover the body of the remote control unit (1), with two holes (2*b*,2*c*) made deep into the connecting walls (2*a*) of the rubber cases (2) to let the latter linked by the guide bar sets to become one piece surrounding the remote control unit (1). There are four sets of guide bars formed by one T-shape bars (3*a*) and two straight bars (3*b*,3*c*), with the T-shape bar (3*a*) connecting the two ends of straight bars (3*b*) inserted into the deep holes (2*b*,2*c*) on the linking rubber cases (2), and the other straight bar (3*c*) linked to the connector (3*c*) in the center. By using the mutual pulling and stretching effect of the connecting parts, the device covers the remote control unit (1) to offer protection. However, as this device has more than 20 parts and is complicated in its assembly, it does not comply with the requirement of low-cost production in this scientific and technological era. Besides, as an accessory, its convenience in use is greatly reduced by too many parts for assembly and the necessity to be stretched or contracted in many directions sequentially.

SUMMARY OF THE INVENTION

The main characteristic of this invention is the use of four moveable, stretchable swinging arms to adjust the size of the, protective case, allowing any one of the swinging arms to adjust its size in both directions, big or small.

The second characteristic of this invention is the use of a bow-shape spring to grip and press the walls of the stretchable swinging arms, allowing such arms to preserve the pressure and tension of the spring during stretching and contracting, and thus allowing the remote control unit to be tightly covered by the protective case.

The third characteristic of this invention is the use of a round base in the center of the protective case to lock the four swinging arms as stated above, allowing these arms to stretch or contract in certain set regions.

The fourth characteristic of this invention is the use of semi-soft, flexible rubber housings, embedded on the abovementioned swinging arms, to cover the existing remote control unit for absorbing external shocks.

The main purpose of this invention is to provide a protective case, for available remote control units of electric or electronic products, that can be used conveniently. The secondary purpose of this invention is to provide a protective case that uses the least number of parts, offers most economical assembly, and requires the least movement of operation. The ultimate goal of this invention is to provide a protective case for remote control unit against collision or shock, while keeping the remote control unit clean.

| Nomenclature of Parts | |
|---|---|
| (1) | Remote Control Unit |
| (2a) | Connecting Walls |
| (3) | Guide Bars |
| (3b) | T-shape Bar |
| (3e) | Connector |
| (11, 12, 13, 14) | Rubber Housings |
| (31, 32) | Springs |
| (45, 56) | Triggers |
| (111, 131) | Upper Caves |
| (13, 133) | Peg Grooves |
| (115, 135) | Rucks |
| (212, 222, 232, 242) | Swinging Arms |
| (214, 224, 234, 244) | Locking Hooks |
| (311, 321) | Heads |
| (411, 421, 431, 441) | Openings |
| (481, 482, 483, 484) | Indentations |
| (2) | Rubber Cases |
| (2b, 2c) | Deep Holes |
| (3a, 3c) | Straight Bars |
| (3d) | Connecting Tube |
| (4) | Base |
| (21, 22, 23, 24) | Embedding Arms |
| (41, 42, 43, 44) | Fan-shape Groove |
| (47) | Incurved Hole |
| (112, 132) | Lower Caves |
| (114, 134) | Linking Surfaces |
| (211, 231) | Heads |
| (213, 223, 233, 243) | Jagged Edges |
| (215, 235) | Inverted Hooks |
| (312, 322) | Tails |
| (451, 461) | Arc Rims |

DETAILED DESCRIPTION OF THE PREFERRED EMBODIMENT

Figure 1:
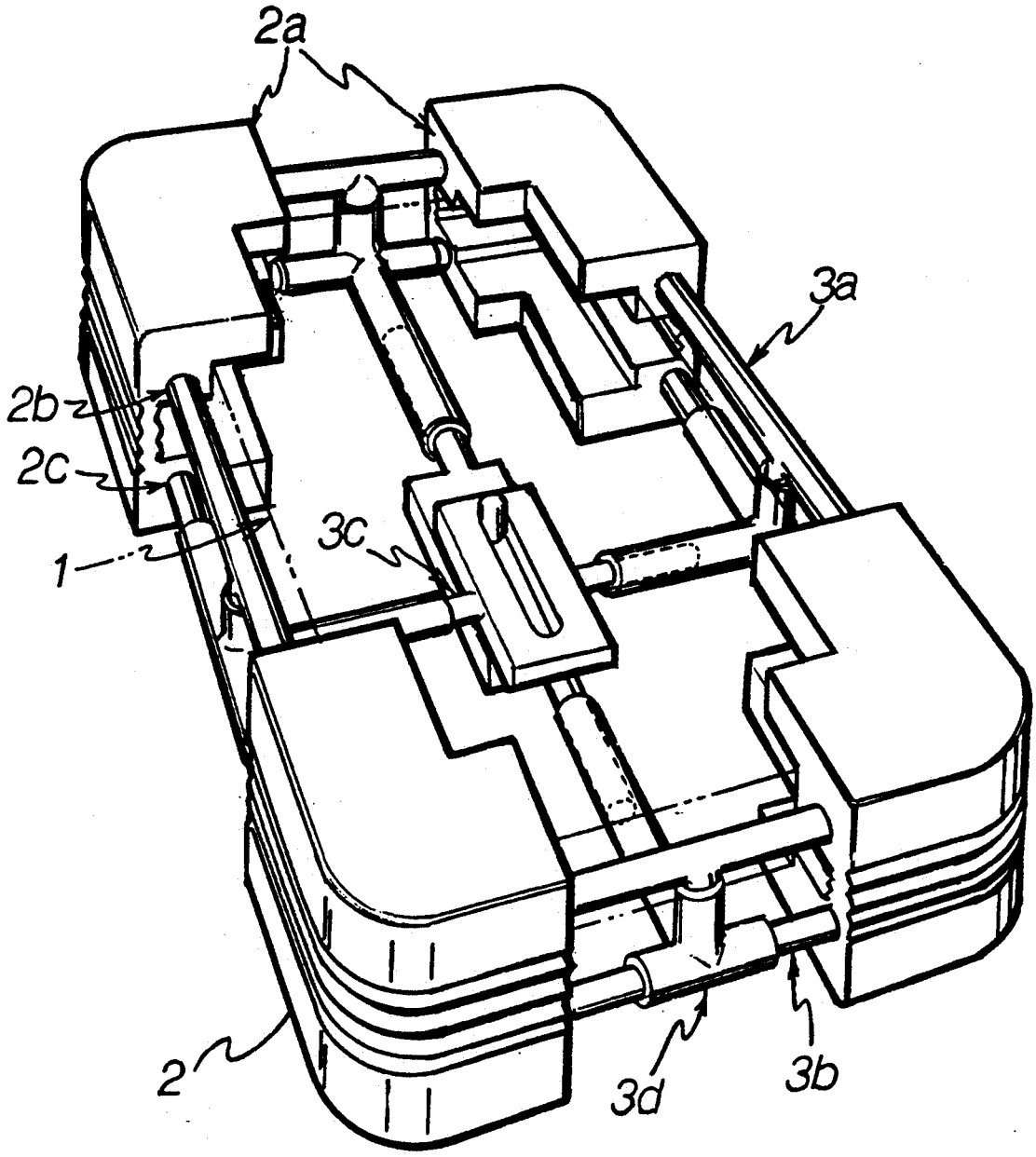
FIG. 1 is an illustrative drawing for an existing protective cover of remote control units.
Figure 2:
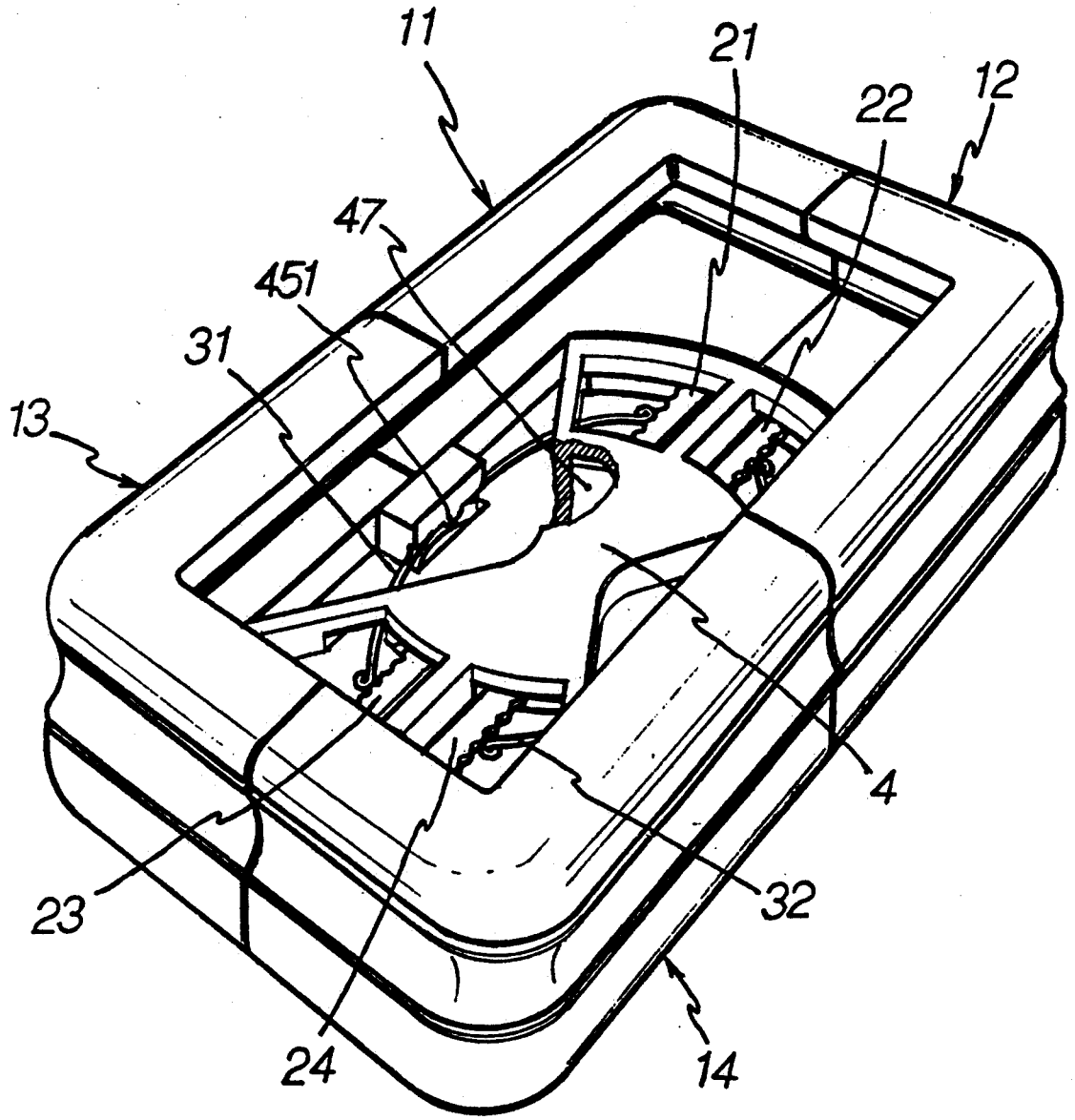
FIG. 2 is a 3-dimensional drawing of this invention.
Figure 3:
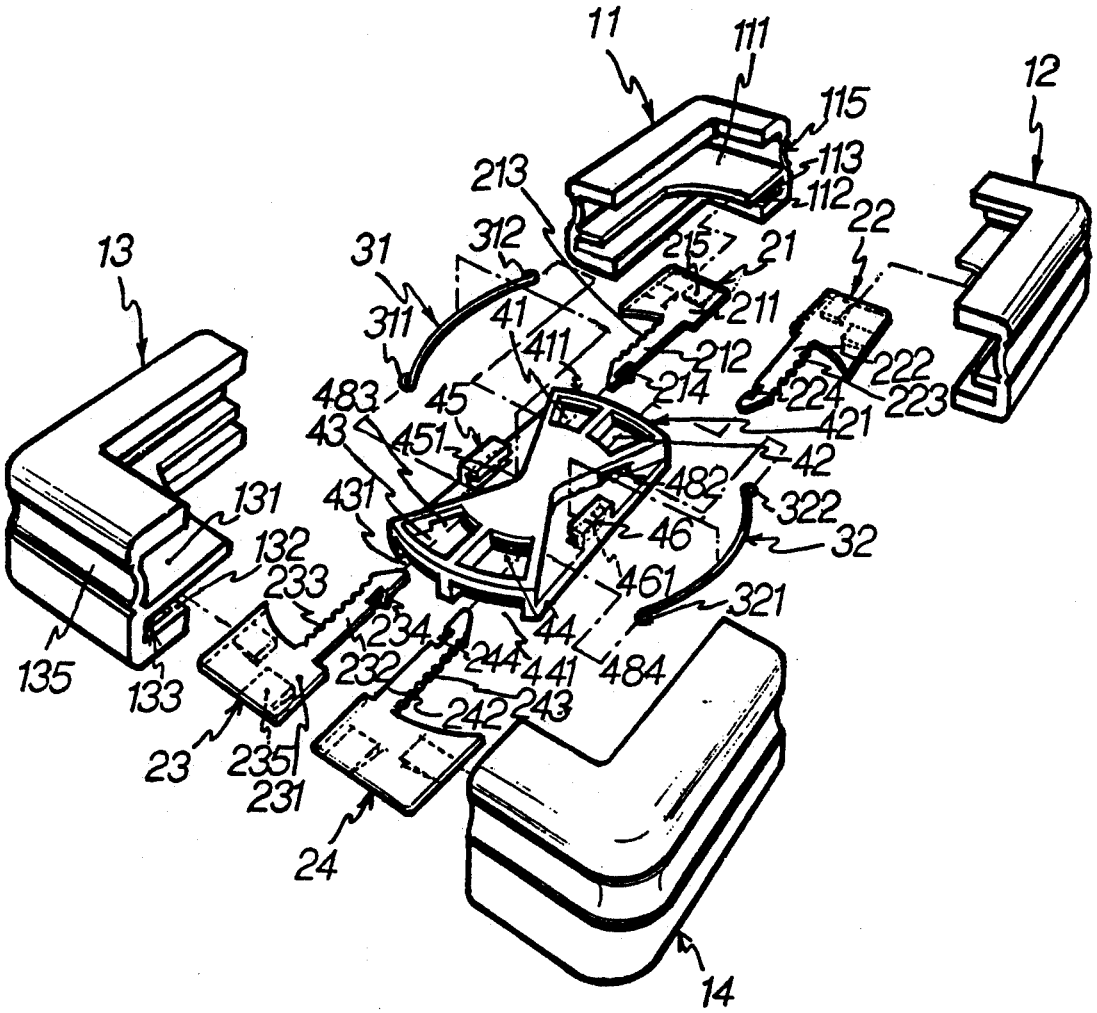
FIG. 3 is an analytical drawing for the structure of this invention.

FIG. 2 shows an example of this invention, which is made up mainly of four soft rubber housings (11,12,13,14), four swinging arms (21,22,23,24) for the rubber housings, two springs (31,32) and a base (4) in a structure shown by FIG. 2 and FIG. 3. The four rubber housings (11,12,13,14) are assembled into a frame. To make the left, right, front and rear rubber housings (11,12,13,14) symmetrical to the corresponding swinging arms (21,2,23,24), rubber housing (11) is exactly the same as rubber housing (13), while rubber housing (12) is the same as rubber housing (14), likewise are the swinging arms (21,23) and (22,24), for the purpose of simplifying the parts. The downcast view of these rubber housings (11,12,13,14) is in L-shape, but the cross section looks E-shape. The assembled product of these parts forms upper caves (111,131) that can cover the four corners of a remote control unit. Besides, horizontal rucks (115,135) are made in the middle of the external walls of the upper caves (111,131) to provide flexibility for the perpendicular stretch and contract of the rubber housings. These rubber housings also have lower caves (112,132) that are equipped with peg grooves (113,133) to let the heads (211,231) of the embedding arms (21,23) to hook into the peg grooves (113,133) with the inverted hooks (215,235) on the tip of the heads (211,231). The other ends of the embedding arms (21,23) are made into swinging arms (212,232) that are inserted into a base (4). The base (4) and embedding arms (21,22,23,24) are made of plastics, and the base (4) is made with corresponding openings (411,421,431,441) on the front and rear ends, and fan-shape grooves (41,42,43,44) behind the openings (411,421,431,441). The base (4) is a elongated board that has a round incurved hole (47) in the bottom of its center, linking with the fan-shape grooves (41,42,43,44) and the openings (411,421,431,441). As a result, when the swinging arms (212,222,232,242) of the above-mentioned rubber case (2) are inserted into the base (4), the locking hooks (214,224,234,244) will shore up with the perpendicular wall of the incurved hole (47), thus preventing the removal of the embedding arms (21,23) from the base (4) by over stretching.

The springs (31,32) are of bow-shape, with their heads (311,312) and tails (321,322) in coil-shape and leaning against the inner walls of the swinging arms (212,222,232,242) of the embedding arms (2). For this purpose, the interior walls of the swinging arms (212,222,232,242) are made with jagged edges (213,223,233,243). As for the springs (31,32), their middle sections are clipped inside the triggers (45,46) on both sides of the base (4), and held by the arc rims (451,461) on the triggers (45,46). The heads and tails (311,312,321,322) of the springs (31,32) go into the fan-shape grooves (41,42,43,44) through four indentations (481,482,483,484) made on the base (4), so as to shore up with the jagged edges (213,223,233,243) of the embedding arms (21,22,23,24). The suitable tension produced by the springs (31,32) provides pressuring force to let the rubber housings (11,12,13,14) on the embedding arms (21,22,23,24) to clip inwards to the center of the base (4).

Figure 4:
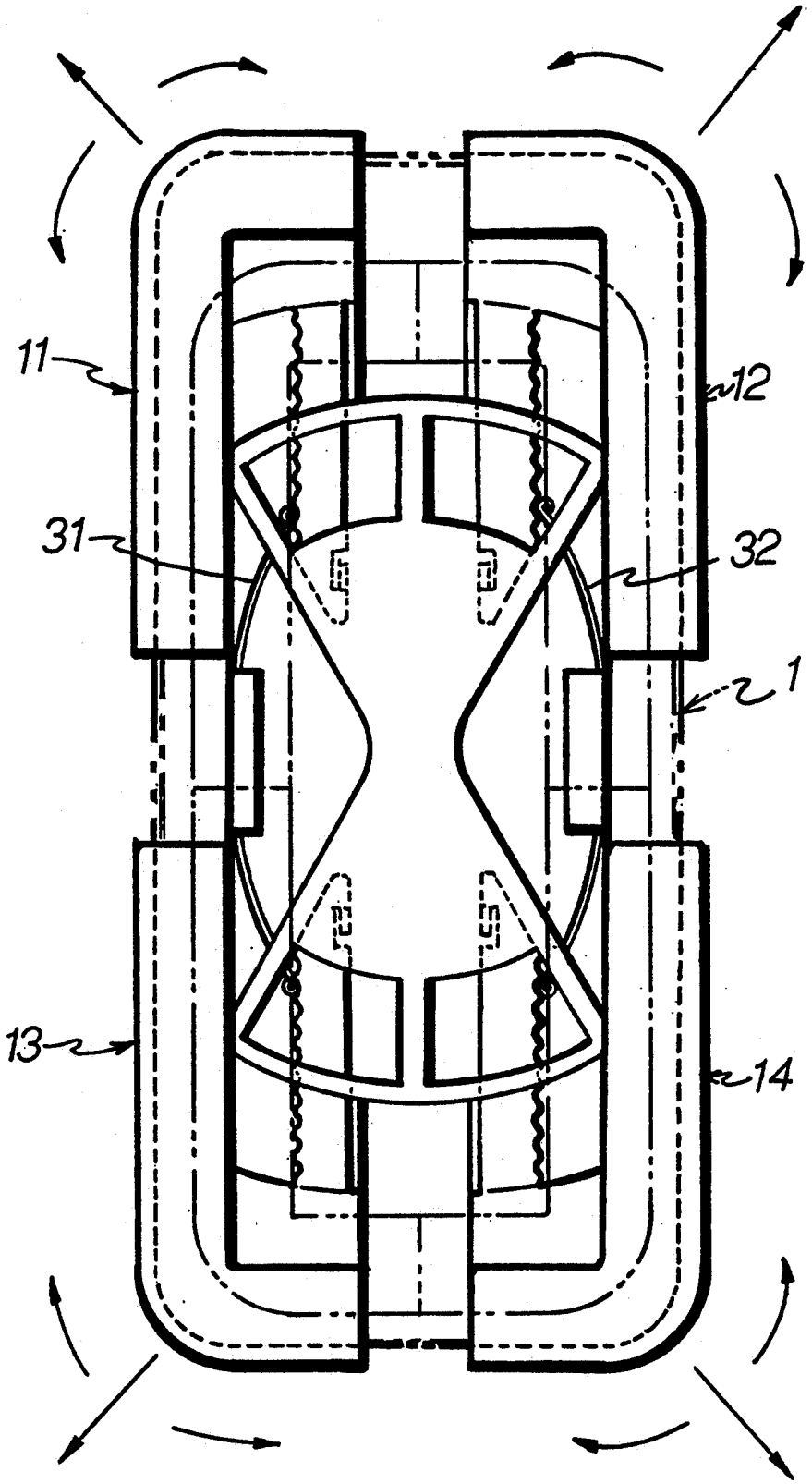
FIG. 4 is an illustrative drawing on the operation of this invention.

As illustrated by FIG. 4, when we put a remote control unit (1) into this invention, the four rubber housings (11,12,13,14) of this invention will grasp the four corners of the case of the remote control unit (1). As the two springs (31,32) of this invention provides the inward clipping force of four rubber housings (11,12,13,14), they really wrap the four corners of the remote control unit (1) closely with the four rubber housings (11,12,13,14), offering suitable protection to the remote control unit (1) against collision with the other hard surface or drop to the floor.

In conclusion, the structure of this invention, when compared with existing products, greatly reduces the cost of production molds due to the use of identical and symmetrical parts, and improve the efficiency of assembly due to small number of parts. As to the users, they can make use of the specially designed swinging arms (212,222,232,242) to adjust the size of this protective case in four directions conveniently to suit the size of their remote control units (1). The structure of this invention is the result of the extensive research and development of the inventor. It is unique, new and very practical.

The foregoing disclosure and description of the invention is illustrative and explanatory thereof. Various changes in the details of the illustrated apparatus may be made within the scope of the appended claims without departing from the true spirit of the invention. The present invention should only be limited by the following claims and their legal equivalents.

What is claimed as now is as following:

1. A protective case for a remote control unit comprising:

a plurality of housings, each of said housings having a space for receipt of a portion of the remote control unit;

a plurality of embedding arms, each of said embedding arms having an end received within one of said plurality of housings;

a base positioned within an area defined by said plurality of housings, said base receiving an opposite end of said embedding arms, said embedding arms movable outwardly relative to said base; and a spring received by said base, said spring having ends in resilient pressured contact with a surface of said embedding arms.

2. The protective case of claim 1, said plurality of housings comprising four L-shaped housings arranged in a generally rectangular configuration, said base positioned centrally of said rectangular configuration.

3. The protective case of claim 1, each of said plurality of housings being formed of a soft plastic material.

4. The protective case of claim 1, each of said plurality of housings having an E-shaped cross-section, said E-shaped cross-section having an upper area for receiving said portion of the remote control unit and a lower area for receiving said end of said embedding arms.

5. The protective case of claim 1, each of said embedding arms having an inverted hook formed on an end received within said housings, said inverted hook for affixing each of said embedding arms to each of said housings.

6. The protective case of claim 1, each of said embedding arms having a locking hook formed on said opposite end received in said base, said locking hook for limiting outward movement of said embedding arms relative to said base.

7. The protective case of claim 1, each of said plurality of embedding arms formed of a rigid material.

8. The protective case of claim 1, each of said embedding arms having a jagged outer surface extending between the ends of said embedding arms, said end of said spring in resilient pressured contact with said jagged outer surface.

9. The protective case of claim 1, said base comprising:

a plate having an incurved hole formed generally on one side of said plate, each of said embedding arms having said opposite end extending into said incurved hole, said plate having a plurality of fan-shaped grooves formed on edges of said plate, each of said embedding arms extending through said fan-shaped grooves.

10. The protective case of claim 9, said plurality of embedding arms comprising four embedding arms, said base having four fan-shaped grooves, said embedding arms extending through separate fan-shaped grooves.

11. The protective case of claim 9, said plate formed of a generally rigid material.

12. The protective case of claim 10, said plate having a first trigger formed on a side of said plate between two of said fan-shaped grooves, said plate having a second trigger formed on another side of said plate between another two of said fan-shaped grooves, said spring comprising:

a first spring received by said first trigger and extending outwardly toward said two fan-shaped grooves; and a second spring received by said second trigger and extending outwardly toward said another two of said fan-shaped grooves.

13. The protective case of claim 12, each of fan-shaped grooves having an indentation formed therein, said springs extending into said indentation.

14. The protective case of claim 13, said springs having ends in abutment with surfaces of said embedding arms so as to bias said embedding arms toward a side of said fan-shaped grooves.

15. The protective case of claim 11, said spring being a bow spring having a center affixed to said base and ends biased against a surface of said embedding arms.

* * * * *